US010173860B2

(12) United States Patent
Anderson et al.

(10) Patent No.: US 10,173,860 B2
(45) Date of Patent: Jan. 8, 2019

(54) ELLIPTICAL REEL FOR HOSE TRANSPORT

(71) Applicant: HALLIBURTON ENERGY SERVICES, INC., Houston, TX (US)

(72) Inventors: Alain Anderson, Duncan, OK (US); Larry Edwin Guffee, Frisco, TX (US); Tori Miller, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 462 days.

(21) Appl. No.: 14/902,875

(22) PCT Filed: Aug. 20, 2013

(86) PCT No.: PCT/US2013/055669

§ 371 (c)(1),
(2) Date: Jan. 5, 2016

(87) PCT Pub. No.: WO2015/026321

PCT Pub. Date: Feb. 26, 2015

(65) Prior Publication Data

US 2016/0159609 A1 Jun. 9, 2016

(51) Int. Cl.

| | |
|---|---|
| ***B65H 75/14*** | (2006.01) |
| ***B65H 75/20*** | (2006.01) |
| ***B65H 75/26*** | (2006.01) |

(52) U.S. Cl.

CPC ..... *B65H 75/146* (2013.01); *B65H 75/14* (2013.01); *B65H 75/20* (2013.01); *B65H 75/26* (2013.01); *B65H 2701/33* (2013.01); *B65H 2701/535* (2013.01)

(58) Field of Classification Search

CPC ..... B65H 75/14; B65H 75/146; B65H 75/20; B65H 75/22; B65H 75/26; B65H 2701/535

See application file for complete search history.

(56) References Cited

U.S. PATENT DOCUMENTS

| | | | | |
|---|---|---|---|---|
| 629,115 A * | 7/1899 | Turney | ..... | B65H 75/14 242/603 |
| 1,868,229 A * | 7/1932 | Gyourko | ..... | B65H 75/14 242/118.8 |
| 1,946,764 A * | 2/1934 | Schaub | ..... | B65H 75/20 242/604 |

(Continued)

FOREIGN PATENT DOCUMENTS

| | | |
|---|---|---|
| JP | 2001145244 | 5/2001 |
| JP | 2002332167 | 11/2002 |
| JP | 2007131367 | 5/2007 |

OTHER PUBLICATIONS

International Patent Application No. PCT/US2013/055669, International Search Report and Written Opinion, dated May 13, 2014, 14 pages.

*Primary Examiner* — Michael R Mansen
*Assistant Examiner* — Nathaniel L Adams
(74) *Attorney, Agent, or Firm* — Kilpatrick Townsend & Stockton LLP

(57) ABSTRACT

An elliptical reel is provided. The elliptical reel can include one or more longitudinal support members about a longitudinal axis of the reel and on which hose can be wound for transport. A cross section of the longitudinal support members that is perpendicular to the longitudinal axis defines an outline that has an elliptical shape.

17 Claims, 4 Drawing Sheets

(56) References Cited

U.S. PATENT DOCUMENTS

| | | | | |
|---|---|---|---|---|
| 5,265,822 | A * | 11/1993 | Shober, Jr. | A61M 5/1418 242/388.2 |
| 6,234,421 | B1 * | 5/2001 | Cox | B65H 75/14 242/588 |
| 6,398,148 | B1 | 6/2002 | Snow | |
| 2004/0178301 | A1 * | 9/2004 | Wampler | B65H 75/146 242/603 |
| 2004/0206849 | A1 | 10/2004 | Harrington | |
| 2008/0245920 | A1 | 10/2008 | Houen | |
| 2008/0283649 | A1 * | 11/2008 | Anger | B65H 75/14 242/370 |

* cited by examiner

ELLIPTICAL REEL FOR HOSE TRANSPORT

CROSS-REFERENCE TO RELATED APPLICATIONS

This is a U.S. national phase under 35 U.S.C. § 371 of International Patent Application No. PCT/US2013/055669, titled "Elliptical Reel for Hose Transport" and filed Aug. 20, 2013, the entirety of which is incorporated herein by reference.

TECHNICAL FIELD

The present disclosure relates generally to a reel on which hose can be wound and, more particularly (although not necessarily exclusively), to a reel having an elliptical cross-section for hose transport.

BACKGROUND

Hose can be wound around circular reels due to the reel maintaining integrity of the hose when it is wound. Circular reels, however, can have a large, circular cross-sectional profile that can diminish transport options.

DETAILED DESCRIPTION

Certain aspects and features relate to a reel that has an elliptical cross-section and on which hose can be wound for transport. The hose may be flexible pipe. An elliptical reel on which hose is wound can fit through smaller openings and doors of transport containers as compared to circular reels. "Elliptical" as used herein means a rounded, non-circular shape. An example of an elliptical shape is an oval shape.

As an example, high pressure hose can be up to 450 feet long. Standard ocean freight shipping containers can be 8 feet by 8 feet by 40 feet long. If an item can be packaged to fit inside a standard shipping container, it can be cheaper to ship than alternative shipping methods such as by air freight, and scheduling can be easier because there are more container ships on regular schedules and containerized freight can be easier to handle at the dock. An elliptical reel according to certain aspects can maintain the minimum bend radius of the hose and can reduce the necessary length and height of the opening of a shipping container, while increasing the axial distance (i.e., width) needed. The reel size can be determined by the minimum bend radius of the hose and many times is larger than a 4 foot radius (8 foot diameter). An elliptical reel can reduce the effective width needed for transport of wound hose.

In some aspects, the wound hose on an elliptical reel is at a non-perpendicular angle to the longitudinal axis of the elliptical real. Viewed from an end of the elliptical reel, the wound hose appears to be elliptically wound. But when viewed at the non-perpendicular angle, wound hose is round with a radius equal to or larger than a minimum bend radius. The elliptical reel can be rotated for transport such that the long axis of the ellipse matches or is less than the diagonal of a container door. This can allow an elliptical reel with hose to fit through a standard cargo door, such as one that is 8 feet by 8 feet.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
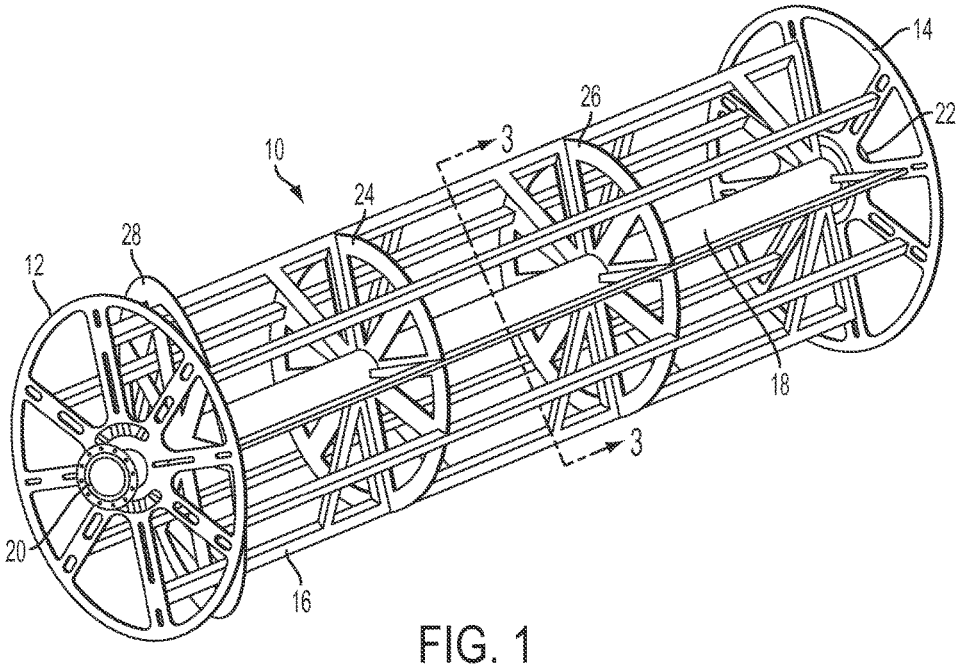
FIG. 1 is a perspective view of an elliptical reel according to one aspect.

In FIG. 1 there is depicted by perspective view an elliptical reel 10 according to one aspect. The elliptical reel 10 includes two external flanges 12, 14 at ends of the elliptical reel 10. Extending between the external flanges 12, 14 along a longitudinal axis of the elliptical reel 10 are a number of longitudinal support members 16 and a drive member 18. The drive member 18 can be coupled, directly or indirectly, to drive flanges 20, 22 that extend from the external flanges 12, 14. Internal flanges 24, 26 are positioned perpendicular to and along the drive member 18. The internal flanges 24, 26 can be spaced periodically along the drive member 18 and connect to the longitudinal support members 16 to provide structural support to the longitudinal support members 16. The internal flanges 24, 26 can have an elliptical surface shape or otherwise an elliptical shape at a cross section that is perpendicular to the longitudinal axis of the elliptical reel 10. One or more internal flanges 24, 26 can be used. In other aspects, internal flanges 24, 26 are omitted.

Figure 2:
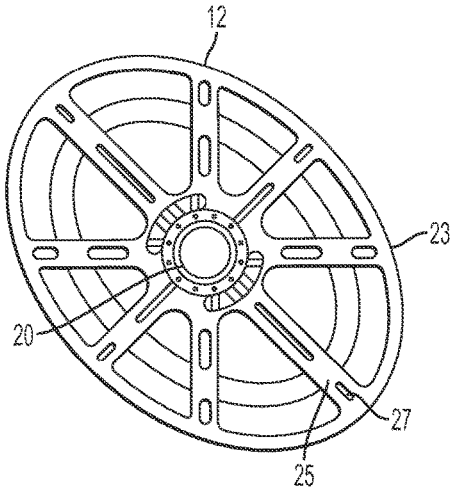
FIG. 2 is a front view of the elliptical reel of FIG. 1 according to one aspect.

FIG. 2 depicts a front view of the elliptical reel 10. Shown in FIG. 2 are the external flange 12 and the drive flange 20. The external flange 12 includes a flange body 23 and spokes, an example of which is labeled 25, extending from the drive flange 20 to the flange body 23. The spokes contain holes or openings, an example of which is labeled 27, that can reduce the weight of the elliptical reel 10 without sacrificing structural support. In other aspects, the spokes do not include holes or openings. The external flange 12 has an elliptical surface shape, or otherwise an elliptical cross-sectional shape. In other aspects, the external flange 12 has a different cross-sectional shape.

Returning to FIG. 1, a guide flange 28 is positioned substantially proximate to the external flange 12 and at a non-perpendicular angle with respect to the drive member 18 and the longitudinal axis. The non-perpendicular angle may be an angle in the range of 100 degrees to 170 degrees with respect to the drive member 18, or otherwise with respect to a longitudinal axis of the elliptical reel 10. In other aspects, the non-perpendicular angle is an angle in the range of 10 degrees to 80 degrees with respect to the drive member 18, or otherwise with respect to a longitudinal axis of the elliptical reel 10.

Figure 3:
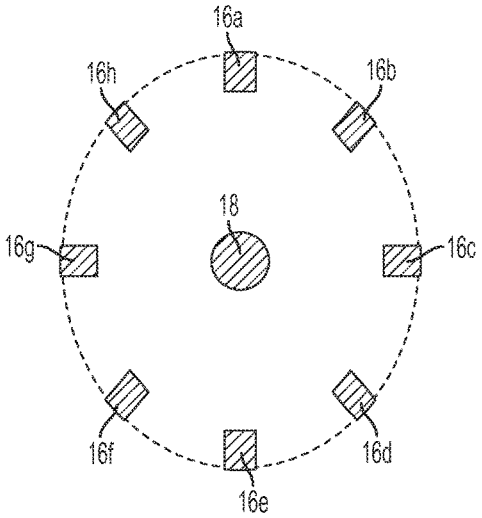
FIG. 3 is a cross-sectional view of the elliptical reel along line 3-3 in FIG. 1 according to one aspect.

The longitudinal support members 16 can define an outline of an ellipse in a cross section of the elliptical reel 10 that is perpendicular to the longitudinal axis of the elliptical reel 10. FIG. 3 depicts a cross section of the elliptical reel 10 taken along line A-A' in FIG. 1. Line 3-3 is perpendicular to the longitudinal axis and the drive member 18 of the elliptical reel 10. Depicted in FIG. 3 are longitudinal support members 16*a-h* about the drive member 18. Certain background components, such as the internal flange 26 and the external flange 14 of FIG. 1, have been omitted for clarity. The longitudinal support members 16*a-h* define an elliptical outline that is shown by a dotted line in FIG. 3. Although eight longitudinal support members are shown in FIG. 3, fewer or more longitudinal support members can be used. In some aspects, four longitudinal support members are used. In other aspects, for example, one longitudinal support member is used that continuously surrounds the drive member 18.

Hose can be wound around the longitudinal support members 16*a-h* such that the hose has an elliptical cross-sectional shape at a cross section that is perpendicular to the longitudinal axis of the elliptical reel 10. For example, at least one of the drive flanges 20, 22 in FIG. 1 can be coupled to a power source that rotates the elliptical reel 10 for winding hose about the longitudinal support members 16. The guide flange 28 can allow the hose to be wound about the longitudinal support members 16 at an angle with respect to the longitudinal axis of the elliptical reel 10 such that the hose can avoid bending more than a desired or rated amount.

Figure 4:
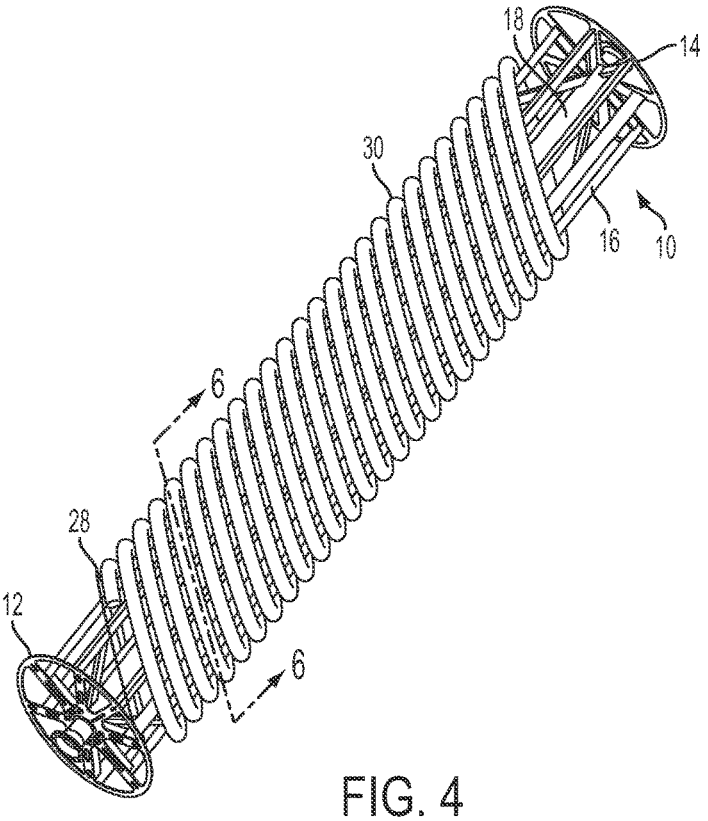
FIG. 4 is a perspective of the elliptical reel of FIG. 1 with hose wound around it according to one aspect.

FIG. 4 depicts by perspective view the elliptical reel 10 with hose 30 wound about the longitudinal support members 16 between the external flanges 12, 14. The hose 30 is wound beginning at the guide flange 28 and extending along the longitudinal support members 16 toward the external flange 14. The guide flange 28 can allow the hose 30 to be wound at a non-perpendicular angle with respect to the longitudinal axis of the elliptical reel, which may correspond to the drive member 18.

Figure 5:
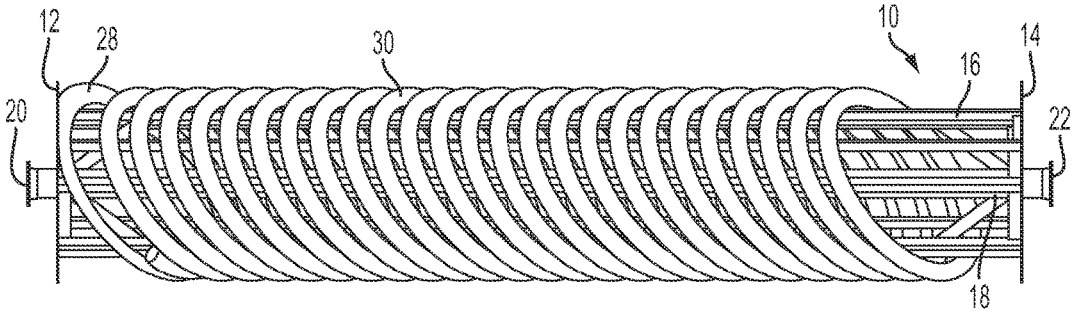
FIG. 5 is a cross-sectional side view of a schematic of the elliptical reel with hose wound around it according to one aspect.

FIG. 5 depicts a side view of a schematic of the elliptical reel 10 with hose 30 wound about the longitudinal support members 16 between the external flanges 12, 14. The drive flanges 20, 22 can define ends of the elliptical reel 10. The hose 30 can be wound at an angle about the longitudinal axis of the elliptical reel 10 that corresponds to an angle of the guide flange 28 with respect to the drive member 18.

Figure 6:
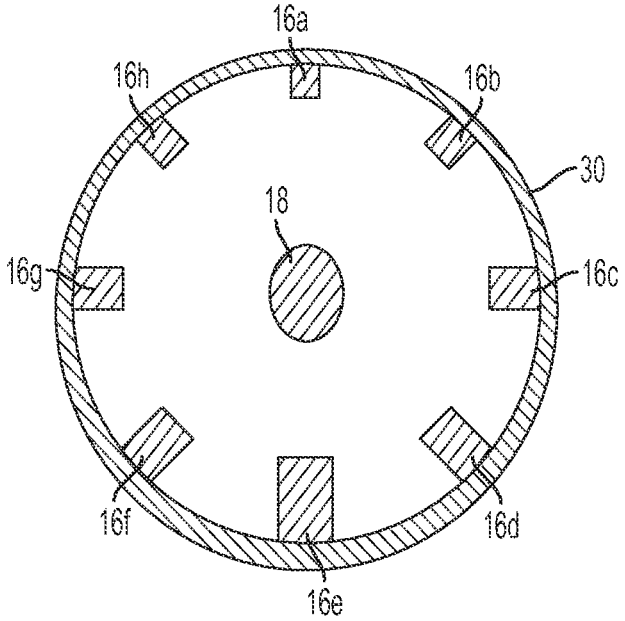
FIG. 6 is a cross sectional view of the elliptical reel and hose along line 6-6 in FIG. 4 according to one aspect.

FIG. 6 depicts a cross section of the elliptical reel 10 and hose 30 taken along line 6-6 in FIG. 4. Line 6-6 is along a non-perpendicular angle with respect to the longitudinal axis and the drive member 18 of the elliptical reel 10. The non-perpendicular angle can be the same angle by which guide flange 28 is positioned with respect to the longitudinal axis and the drive member 18. The hose 30 has a substantially circular shape at this cross-sectional angle. The longitudinal support members 16*a-h* also define an outline that is circular about the drive member 18 at this angle of cross-section.

Figure 7:
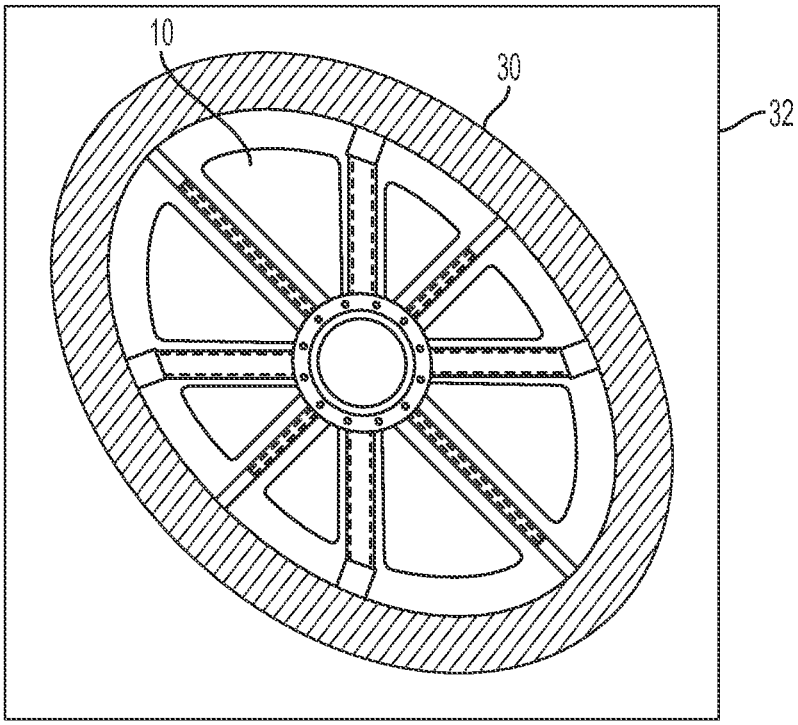
FIG. 7 is a front view of an elliptical reel with hose wound around it and in a transport container according to one aspect.

The perpendicular cross-section of the elliptical reel 10 and hose 30 is an elliptical shape that can allow the elliptical reel 10 with the hose 30 to be transported in a larger variety of containers. For example, FIG. 7 depicts an outline of a container 32, which may be a standard ocean-based shipping container that is 8 feet by 8 feet. The elliptical reel 10 and hose 30 can have an elliptical cross-sectional shape such that the elliptical reel 10 and hose 30 can be angled to fit within the container 32, where circular reels may not fit.

Elliptical reels according to some aspects allow hoses with minimum bend radii greater than four feet to be stored and transported in a compact package that can be moved through an 8 feet by 8 feet opening of a shipping container. A hose can be spooled off the reel in a more controlled fashion than lifting the hose out of a storage container by sections, which can reduce the possibility of the hose kinking during loading and unloading operations.

In one aspect, a reel for hose transport is provided. The reel includes at least one longitudinal support member about a longitudinal axis of the reel and on which the hose is woundable. The longitudinal support member defines an outline that has an elliptical cross-sectional shape at a cross section that is perpendicular to the longitudinal axis.

In some examples of the reel, the reel includes a guide flange positioned at a non-perpendicular angle with respect to the longitudinal axis and by which the hose is woundable at the non-perpendicular angle with respect to the longitudinal axis.

In some examples of the reel, the reel also includes external flanges and a drive member. The guide longitudinal support member extends between the external flanges. The drive member is along the longitudinal axis and is coupled to the external flanges.

In some examples of the reel, the reel also includes an internal flange and drive flanges. The internal flange has an elliptical surface shape and is connected to the longitudinal support member. The drive flanges extend from the external flanges.

In some examples of the reel, at least one of the external flanges has an elliptical surface shape.

In some examples of the reel, the hose is wound about the longitudinal axis. The hose has the elliptical cross-sectional shape at a cross section that is perpendicular to the longitudinal axis. The hose has a substantially circular cross-sectional shape at a cross section that is non-perpendicular to the longitudinal axis.

In some examples of the reel, the reel also includes a guide flange about the longitudinal support member and at a non-perpendicular angle with respect to the longitudinal axis. The hose is wound beginning at the guide flange.

In some examples of the reel, the hose is wound about the longitudinal axis and has a cross-sectional shape corresponding to the outline that has the elliptical cross-sectional shape.

In some examples of the reel, the reel, including the hose wound about the longitudinal axis, is positionable in a shipping container that is eight fee by eight feet.

In another aspect, an elliptical reel is provided. The elliptical reel includes a drive member, longitudinal support members, and a guide flange. The drive member defines a longitudinal axis of the elliptical reel. The longitudinal support members extend along the longitudinal axis and about the drive member. The guide flange is about the longitudinal support members and defines a beginning point at which hose is woundable along the longitudinal axis such that the hose has an elliptical cross-sectional shape at a cross section that is perpendicular to the longitudinal axis.

In some examples of the elliptical reel, the elliptical reel also includes a first external flange, a second external flange, an internal flange, and a drive flange. The driver member and the longitudinal support members are positioned between the first external flange and the second external flange. The internal flange supports the longitudinal support members. The drive flange is coupled to the drive member through the first external flange or the second external flange.

In some examples of the elliptical reel, the longitudinal support members define an outline that has the elliptical cross-sectional shape at the cross section that is perpendicular to the longitudinal axis.

In some examples of the elliptical reel, the guide flange is positioned at a non-perpendicular angle with respect to the longitudinal axis.

In some examples of the elliptical reel, the hose is wound about the longitudinal support members beginning at the guide flange. The hose has the elliptical cross-sectional shape at the cross section that is perpendicular to the longitudinal axis. The hose has a substantially circular cross-sectional shape at a cross section that is non-perpendicular to the longitudinal axis. The cross section that is non-perpendicular to the longitudinal axis is at an angle with respect to the longitudinal axis that is the non-perpendicular angle at which the guide flange is positioned with respect to the longitudinal axis.

In some examples of the elliptical reel, the elliptical reel with the hose is positioned in a shipping container that is eight feet by eight feet.

In some examples of the elliptical reel, the guide flange is positioned at an angle with respect to the longitudinal axis that is in a range of ten degrees to eighty degrees or a range of one hundred degrees to one hundred seventy degrees.

In another aspect, an assembly is provided that includes a reel and a hose. The reel includes longitudinal support members about and along a longitudinal axis. The reel also includes a guide flange at a non-perpendicular angle with respect to the longitudinal axis. The hose is wound beginning at the guide flange and about the longitudinal support members. The hose has an elliptical cross-sectional shape at a cross section that is perpendicular to the longitudinal axis.

In some examples of the assembly, the hose has a substantially circular cross-sectional shape at a cross section that is non-perpendicular to the longitudinal axis.

In some examples of the assembly, the reel also includes external flanges at ends of the reel, a drive member, and an internal flange. The longitudinal support members are between the external flanges. The drive member is along the longitudinal axis of the reel and between the external flanges. The internal flange is coupled to the longitudinal support members.

In some examples of the assembly, the longitudinal support members define an outline that has the elliptical cross-sectional shape at the cross section that is perpendicular to the longitudinal axis.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly, comprising:

a reel that includes (i) longitudinal support members about and along a longitudinal axis and (ii) a guide flange at a non-perpendicular angle with respect to the longitudinal axis; and hose wound beginning at the guide flange and about the longitudinal support members, the hose having an elliptical cross-sectional shape at a first cross section that is perpendicular to the longitudinal axis, and the hose having a substantially circular cross-sectional shape at a second cross section that is parallel to the non-perpendicular angle.

2. The assembly of claim 1, wherein the reel includes:

external flanges at ends of the reel, the longitudinal support members being between the external flanges;

a drive member along the longitudinal axis of the reel and between the external flanges; and an internal flange coupled to the longitudinal support members.

3. The assembly of claim 1, wherein the longitudinal support members define an outline that has the elliptical cross-sectional shape at the first cross section that is perpendicular to the longitudinal axis, and the outline has a substantially circular cross-sectional shape at the second cross section that is parallel to the non-perpendicular angle.

4. An elliptical reel, comprising:

a drive member defining a longitudinal axis of the elliptical reel;

longitudinal support members extending along the longitudinal axis and about the drive member; and a guide flange positioned at a non-perpendicular angle with respect to the longitudinal axis and about the longitudinal support members and defining a beginning point at which hose is woundable along the longitudinal axis such that the hose has an elliptical cross-sectional shape at a first cross section that is perpendicular to the longitudinal axis and a substantially circular cross-sectional shape at a second cross section that is parallel to the non-perpendicular angle.

5. The elliptical reel of claim 4, comprising:

a first external flange;

a second external flange, the drive member and the longitudinal support members being positioned between the first external flange and the second external flange;

an internal flange supporting the longitudinal support members; and a drive flange coupled to the drive member through the first external flange or the second external flange.

6. The elliptical reel of claim 4, wherein the longitudinal support members define an outline having the elliptical cross-sectional shape at the first cross section that is perpendicular to the longitudinal axis.

7. The elliptical reel of claim 4, wherein the hose is wound about the longitudinal support members beginning at the guide flange, the hose having the elliptical cross-sectional shape at the first cross section that is perpendicular to the longitudinal axis, the hose having the substantially circular cross-sectional shape at a the cross section that is parallel to the non-perpendicular angle.

8. The elliptical reel of claim 7, wherein the elliptical reel with the hose is positioned in a shipping container that is eight feet by eight feet.

9. The elliptical reel of claim 4, wherein the non-perpendicular angle is in a range of ten degrees to eighty degrees or a range of one hundred degrees to one hundred seventy degrees.

10. A reel for hose transport, the reel comprising:

at least one longitudinal support member about a longitudinal axis of the reel and on which the hose is woundable, the at least one longitudinal support member defining an outline that has an elliptical cross-sectional shape at a first cross section that is perpendicular to the longitudinal axis; and a guide flange positioned at a non-perpendicular angle with respect to the longitudinal axis and by which the hose is woundable at the non-perpendicular angle with respect to the longitudinal axis, wherein the at least one longitudinal support member defining the outline has a substantially circular cross-sectional shape at a second cross section that is parallel to the non-perpendicular angle.

11. The reel of claim 10, further comprising:

external flanges, the at least one longitudinal support member extending between the external flanges; and a drive member along the longitudinal axis and coupled to the external flanges.

12. The reel of claim 11, further comprising:

an internal flange having an elliptical surface shape and connected to the at least one longitudinal support member; and drive flanges extending from the external flanges.

13. The reel of claim 11, wherein at least one of the external flanges has an elliptical surface shape.

14. The reel of claim 10, wherein the hose is wound about the longitudinal axis, the hose having the elliptical cross-sectional shape at a cross section that is perpendicular to the longitudinal axis, the hose having the substantially circular cross-sectional shape at a cross section that is non-perpendicular to the longitudinal axis.

15. The reel of claim 14, wherein the guide flange is positioned about the at least one longitudinal support member, wherein the hose is wound beginning at the guide flange.

16. The reel of claim 10, wherein the hose is wound about the longitudinal axis and has a cross-sectional shape corresponding to the outline that has the elliptical cross-sectional shape.

17. The reel of claim 16, wherein the reel including the hose wound about the longitudinal axis is positionable in a shipping container that is eight feet by eight feet.

* * * * *